US011346061B2

(12) United States Patent
Stieglbauer

(10) Patent No.: US 11,346,061 B2
(45) Date of Patent: May 31, 2022

(54) ROAD SURFACING SYSTEM

(71) Applicant: Andreas Stieglbauer, Obertraubling (DE)

(72) Inventor: Andreas Stieglbauer, Obertraubling (DE)

( * ) Notice: Subject to any disclaimer, the term of this patent is extended or adjusted under 35 U.S.C. 154(b) by 0 days.

(21) Appl. No.: 16/934,923

(22) Filed: Jul. 21, 2020

(65) Prior Publication Data

US 2021/0062434 A1 Mar. 4, 2021

(30) Foreign Application Priority Data

Aug. 29, 2019 (DE) ..... 10 2019 123 161.2

(51) Int. Cl.
*E01C 3/00* (2006.01)
*E01C 7/30* (2006.01)

(52) U.S. Cl.
CPC . *E01C 7/30* (2013.01); *E01C 3/00* (2013.01)

(58) Field of Classification Search
CPC ..... E01C 3/00; E01C 7/30
USPC ..... 404/17–24, 28–31, 72, 75
See application file for complete search history.

(56) References Cited

U.S. PATENT DOCUMENTS 4,210,457 A * 7/1980 Dodson ..... C04B 28/04 106/675
4,396,312 A 8/1983 Nilsson
2007/0223998 A1 9/2007 Hartenburg
2014/0235781 A1* 8/2014 Bower ..... C08L 21/00 524/493
2014/0251186 A1* 9/2014 Cross ..... C04B 28/04 106/709
2014/0322459 A1 10/2014 Tetrault et al.
2018/0030238 A1* 2/2018 Hicks ..... E01C 7/085
2020/0255629 A1* 8/2020 Sahajwalla ..... B29B 17/0412

FOREIGN PATENT DOCUMENTS

DE 102004006165 A1 8/2005

OTHER PUBLICATIONS

Office Action issued in German Patent Application No. 10 2019 123 161.2 dated Jun. 16, 2020 (10 pages).

* cited by examiner

*Primary Examiner* — Raymond W Addie
(74) *Attorney, Agent, or Firm* — MH2 Technology Law Group LLP

(57) ABSTRACT

The present invention relates to a road surfacing system, in particular an asphalt road, which comprises at least one main layer which is at least partially and at least in places permeable to liquids and gases for absorbing compressive and shear forces generated on the main layer by load bodies, for example vehicles, travelling and/or standing on the main layer, wherein the main layer is arranged on a drainage layer through which liquids and/or gases can flow, and further where-in the drainage layer is again arranged on top of a drainage layer which is arranged and intended to at least partially drain liquids from the road surfacing system passing through the main and drainage layers, characterized in that the main layer is substantially free from aggregates and instead is formed with adhering ball elements formed with a plastic and/or a metal.

16 Claims, 1 Drawing Sheet

ROAD SURFACING SYSTEM

Figure 1:
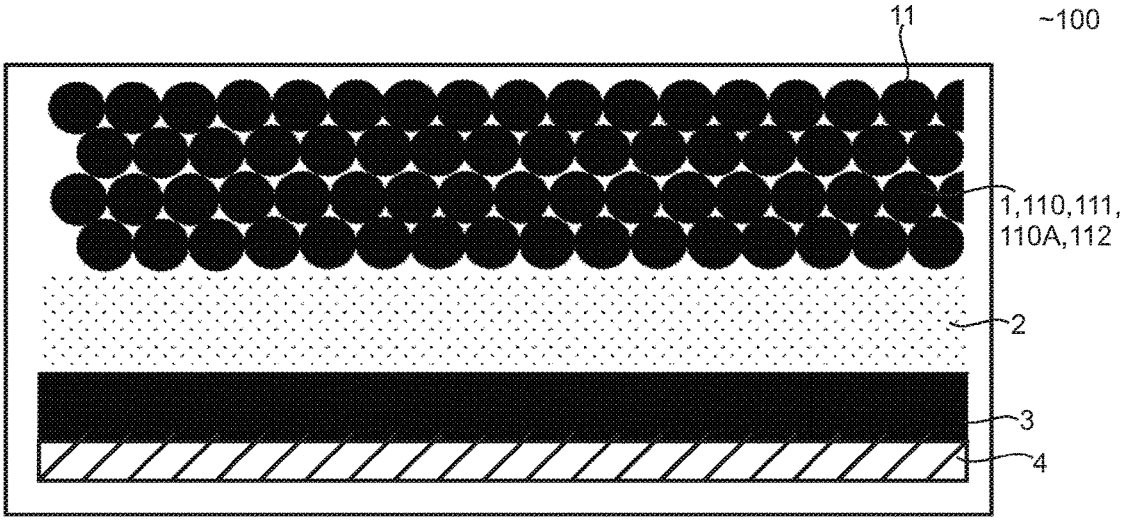

The present invention relates to a road surfacing system, in particular an asphalt road, a main layer, in particular as a component of an asphalt road, and a method for producing a road surfacing system, in particular an asphalt road.

Due to the ever-increasing load from road traffic and the resulting damage to the road surfaces, the present invention is intended to propose a completely new road surfacing system, in particular a new asphalt road, in which the damage caused by the weight load and/or by weather influences is minimized.

Due to a weight load, e.g. by trucks, and the simultaneously inflexible structure of previously known road surfaces, permanent damage, e.g. ruts, cracks, holes or the like, can occur in a road surface system, i.e. a road surface or at least part of it.

Weather influences bear dangers, such as aquaplaning caused by rainwater, lightning and black ice, freezing water or freezing wetness in winter, blow ups caused by excessive heat development, which can be caused by expansion of the inflexible road pavement.

At the same time, a road surfacing system must be offered in which the contact surface that comes into contact with the load-bearing bodies, for example vehicles, remains as free of dust and dirt as possible.

Based on this, it is therefore a task of the present invention to offer a road surfacing system which eliminates the above mentioned disadvantages in a particularly inexpensive and simple way and therefore such a road surfacing system is offered in which dangers caused by weather influences, such as aquaplaning, as well as reversible and irreversible damages to the road surfacing system are minimized.

This problem is solved by the subject-matter of claim 1.

The road surfacing system proposed here, in particular the asphalt road proposed here, therefore comprises at least one main layer which is at least partially and at least in places permeable to liquids and gases for absorbing compressive and shear forces generated on the main layer by load bodies travelling and/or standing on it, for example by vehicles.

The main layer may be a carrier layer which does not necessarily come into direct contact with load bodies, such as vehicles, for example, but it may be the case that the main layer is a layer on which a surface and/or road surface layer is arranged directly or indirectly. In this case, the load-bearing bodies would only come into direct contact with the surface and/or pavement layer of the road surface system, so that the main layer can also act as a support and force distribution layer.

In addition, however, it is possible that the load-bearing elements standing or moving on the main layer actually come into direct contact with the vehicles. Such a main layer is or serves therefore also as a road surfacing layer and therefore as the top layer which closes the road system in the direction of the load bodies.

Further, the road surfacing system comprises a drainage layer which is arranged below the main layer, directly or indirectly, and through which liquids and/or gases can flow, and further, wherein the drainage layer is in turn arranged on a drainage layer which is arranged and intended to at least partially drain liquids flowing through the main and drainage layers from the road surfacing system.

The drainage layer may also be a frost protection layer which has a thermal insulation effect on the layers arranged thereon, i.e. the drainage layer arranged on the covering layer and the main layer. In this respect, the drainage layer and the main layer are protected against freezing liquids, which means that in winter, and at any rate at low temperatures, the individual holes and liquid and gas conducting channels cannot become blocked and remain at least essentially free.

A constant removal of liquids and gases, which flow through the layers from the direction of the load bodies, can therefore always be generated and maintained. Furthermore, the drainage layer can also be identical to the road surface or any other gravel layer. In such a case, it is therefore conceivable that the drainage layer is not specially applied to the road surface, but that the road surface system consists only of one or more drainage layers and/or one or more main layers.

According to at least one design, the main layer is essentially free of aggregates and is instead formed with adhering ball elements formed with a plastic and/or a metal.

"Essentially" in this context means that, within the manufacturing tolerance, the main layer is at least not specifically interspersed with stone bodies.

This can be an essential element of the present invention, in at least one embodiment, which does not require the formation of a main layer based on rocks. Previously known road surfacing systems always have a main layer which comprises corresponding rock bodies.

For the purposes of the present invention, "spherical elements" means any spherical or approximately spherical element. "Spherical" can therefore explicitly also mean a formation of the individual spherical elements in the form of ellipsoids or elements deviating therefrom, but essentially without edges.

According to at least one design form, the road surfacing system comprises in particular the asphalt road described here, at least one main layer, at least partially and at least in places permeable to liquids and gases, for absorbing compressive and shear forces generated on the main layer by load bodies moving and/or standing on it, for example vehicles, wherein the main layer is disposed on a drainage layer through which liquids and/or gases can flow and further wherein the drainage layer is in turn disposed on a drainage layer which is adapted and provided to at least partially drain liquids from the road surfacing system passing through the main and drainage layers.

In at least one form of construction according to the invention, the main layer is essentially free of aggregates, and instead is formed with ball elements adhering to each other, which are formed with a plastic and/or a metal.

According to at least one design, the drainage layer is at least partially formed with aggregates. This may mean that the drainage layer is at least partially, but preferably completely, formed with a rock, for example pebbles or siliceous rock elements. The drainage layer in this form may therefore differ fundamentally from the structure of the main layer in that the drainage layer contains aggregates, while the main layer is essentially free of such aggregates.

According to at least one design form, the ball elements produce a cavity content in volume % within the main layer of at least 10 to at most 35, preferably of at least 20 to at most 30 and further preferably of at least 22 to at most 28.

Such a cavity content ensures that, on the one hand, the individual ball elements are positioned loosely and sufficiently flexible and elastic relative to one another and, on the other hand, that a sufficient throughput volume can be generated with respect to the liquids and gases passing through. Accumulation of a side and/or surface of the main layer of liquids and/or gases on the side facing away from the drainage layer, but especially blow ups, can thus be avoided.

The ball elements are preferably formed with a solid material. In this respect, the ball elements are then preferably free of cavities formed inside the ball elements.

According to at least one design, the ball elements are each formed with a hard core and an outer layer, which preferably completely surrounds the hard core, where-in the outer layer is formed with a material which is softer than the hard core on a Shore D scale.

The hard core is therefore, as mentioned above, preferably a solid core material, so that the hard core is free of a cavity formed within the hard core. The hard core is therefore preferably completely formed by the corresponding hard core material.

According to at least one design, the outer layer is at least two points softer on the Shore D scale than the hard core of each of the ball elements.

Such a hardness and difference has therefore proved to be particularly advantageous because, on the one hand, elastic properties of the main layer, especially when hardened, are given through the soft outer layer material, but, on the other hand, mechanical resistance can be produced by the hard core described here and its degree of hardness.

According to at least one design, the hard core is formed with a metal, while the outer layer is formed with the plastic and/or an adhesive.

The ball elements described here can therefore either consist of at least two different materials, or the ball elements consist of one material and are provided with an adhesive to join them together to form the main layer, or are embedded in such an adhesive (possibly heated beforehand), so that in such a case the adhesive is to be understood as a binding mass for joining the ball elements to form a liquid or viscous mass.

According to at least one design, the ball elements are mechanically connected to one another by means of their outer layers, which have been cured after previous heating, and/or by means of a cured bonding agent, for example a or the bonding adhesive, in particular also the above-mentioned adhesive. This can ensure that the main layer not only has elastic properties and therefore always returns to its original shape after mechanical stress, but can also resist mechanical stress, so that not only the shape is retained, but also, for example, ruts are avoided completely, at least partially.

According to at least one design form, the outer layer of the balls and/or the bonding agent is formed by means of an organic or inorganic adhesive.

It is conceivable that the material for the hard core could be a metal, a metallic alloy or any other material provided with a metal. For example, the hard core is formed with a stainless steel which is covered by an industrial rubber, such as EPDM rubber (ethylene-propylene-diene/rubber ethylene-propylene-diene-M group).

The individual hard cores are then bonded to each other over a thin surface area by one or more organic adhesives, such as the one-component epoxy resin adhesive. The individual hard cores are then joined together only when they are applied to the drainage layer, as the adhesive can then be heated on site. Only after the adhesive has been applied, and thus after the individual balls have been joined together to form the moving mass that forms the main layer, does it bond the individual balls to each other like an adhesive, and only then does the adhesive set.

After application of the main layer and curing of such an adhesive, the outer surface of the main layer facing the vehicles can also be roughened in order to obtain better friction and adhesion values.

Furthermore, the present invention relates to a main layer, in particular as a constituent part of an asphalt road, whereby the main layer can be produced in the form of at least one of the above-mentioned designs. This means that all the features carried out for the features described above, in particular in relation to the main layer, also apply to the main layer now shown and vice versa.

The main layer described here, in particular as a component of an asphalt road, is at least partially and at least in places permeable to liquids and gases, whereby the main layer is designed and intended to withstand pressure and/or shear forces generated thereon by load bodies moving and/or standing on it, for example vehicles.

Thereby, in at least one embodiment, the main layer is free of aggregates and is instead formed with ball elements adhering to each other, which are formed with a plastic and/or a metal.

The main layer described here has the same advantages of the advantageous design as already described in connection with the road surface system described above and vice versa.

Furthermore, the present invention relates to a method for producing a road surfacing system, in particular an asphalt road comprising the steps of first applying a drainage layer on a road base, wherein in a second step a drainage layer is arranged on the drainage layer, wherein in a third step the main layer is arranged on the drainage layer.

Between the individual layers, however, several further layers may be arranged. In this respect, in the sense of the invention, "application" means only an arrangement on one of the layers relative to another layer. Application can mean that there is a direct contact between layers applied to each other, or between layers applied to each other there are further layers, for example one or more layers.

The main layer described here is at least partially and at least in places permeable to liquids and gases, whereby the main layer is designed and intended to withstand pressure and/or shear forces generated thereon by load bodies moving and/or standing on it, for example vehicles.

The drainage layer described is arranged and intended to be at least partially permeable to liquids and/or gases, the drainage layer being arranged and intended to at least partially drain liquids from the road surface system passing through the main layer and through the drainage layer.

In at least one configuration, the main layer is substantially free of aggregates as described in the method described herein and is formed instead with spherical elements formed with a plastic or a metal.

In principle, the following non-exhaustive list of materials can be considered as materials for the outer layer and/or the bonding adhesive:

| Material group | Modification | SHORE D |
|---|---|---|
| ABS | | 75-93 |
| | ABS + 30M.-% GF | 62-68 |
| | ABS/TPE | 46 |
| | ABS/TPU | 58-68 |
| ASA | | 75 |
| ETFE | | 60-78 |
| EVA | | 17-45 |
| PA 11 | PA 11 + 23M.-% GF | 70 |
| PA 12 | PA 12 (humid) | 75-78 |
| | PA 12 + 30M.-% GF (humid) | 75 |
| PA 612 | | 73 |
| PA 6 | PA 6 (humid) | 52-77 |
| | PA 6 + 30M.-% GF | 48-80 |
| | PA 6 + 30M.-% GF (dry) | 84 |
| PA 66 | PA 66 + 30M.-% GF | 77-82 |

-continued

| Material group | Modification | SHORE D |
|---|---|---|
| | PA 66 + 30M.-% GB | 81 |
| | PA 66 + 30M.-% MX | 75-82 |
| PAEK | | 86-90 |
| | PAEK + 30M.-% GF | 90 |
| PBI | | 99 |
| PBT | | 79-86 |
| | PBT + 30M.-% GF | 53-85 |
| | PBT + 30M.-% GX | 54 |
| PC | | 51-85 |
| | PC + 30M.-% GF | 65-72 |
| | PC + 30M.-% GX | 70 |
| PCTFE | | 76-80 |
| PE-HD | | 56-69 |
| PE-LD | | 39-83 |
| PE-LLD | | 38-60 |
| PE-MD | | 45-60 |
| PE-UHMW | | 60-65 |
| PEEK | | 83-88 |
| PEI | | 88-90 |
| PEK | | 87 |
| | PEK + 30M.-% GF | 90 |
| PET | PET + 30M.-% GF | 63-65 |
| PMMA | | 52-85 |
| | PMMA + 30M.-% GF | 55 |
| POM | | 52-83 |
| PP | | 59-77 |
| | PP + 30M.-% GF | 62-80 |
| | PP + 30M.-% CD | 74-75 |
| | PP + 30M.-% MF | 60-74 |
| | PP + 30M.-% P | 65 |
| | PP + 30M.-% $CaCO_3$ | 55-70 |
| | PP/EPDM | 40 |
| PS | | 78-80 |
| PTFE | | 50-90 |
| PUR | | 20-84 |
| PVC-U | | 74-94 |
| | PVC-U/NBR | 58-74 |
| PVC-P | | 42-77 |
| PVC-C | | 82 |
| PVDF | | 46-79 |
| SAN | | 45-85 |
| SMMA | | 72-82 |
| TPC | | 28-82 |
| TPE | | 48-78 |
| | TPE/PTFE | 56 |
| TPE-E | TPE-E + 30M.-% GF | 55 |
| TPO | | 16-70 |
| TPS | | 60 |
| TPU | TPU + 30M.-% GF | 74-80 |
| TPV | | 40-51 |

whereby the following applies:
GF: glass fibres
GB: Glass Balls
MF: mineral fibres
MX: unspecified mineral filling
GX: unspecified glass filling
CD: Carbon meal
P: unspecified filling flour According to at least one design, an outer surface of the ball elements is applied to the drainage layer in the still heated and thus bonded state, so that after the application of the individual ball elements, they cool down to an ambient temperature during cooling and thus bond to each other, so that a hardened road surface results, in particular in the form of the main layer.

The designs described here are advantageous in terms of the process, and are also evident for the road surfacing system described above and vice versa.

In the following the inventions are described in more detail by means of two figures.

FIG. 1 shows a longitudinal section along a direction of the roadway of the road pavement system 100 described here, whereas FIG. 1 shows a corresponding section in a direction transverse to the direction of the roadway of the road pavement system described in FIG. 1.

In the figures, the same or similarly acting components are provided with the same reference lines, even if individual elements may be represented in exaggerated detail.

FIG. 1 shows a road surfacing system 100, in particular an asphalt road, with a drainage layer 2 on a drainage layer 3 and a main layer 1 on this drainage layer 2.

The main layer 1 is essentially free of aggregates and instead is formed with adherent ball elements 11, which are formed with a plastic and/or a metal.

The drainage layer 2 is designed in such a way that liquids and gases can flow through it, so that drainage in the direction of the drainage layer 3 is ensured.

The drainage layer 3 is designed to allow liquids from the entire road surface system to run off at least partially (as shown in the longitudinal section as an example, V-shaped and on both sides towards the side), but preferably completely, in particular by itself, starting from an outer surface of the drainage layer 3 passing through the main layer 1 in the direction of the drainage layer 3.

This can mean that the existing drainage layer is formed in at least one version with aggregates, preferably completely with aggregates, which fundamentally distinguishes the existing drainage layer in its material, structural formation from main layer 1.

The spherical elements 11 form clearly recognisable cavities between one another in FIG. 1, so that the cavities (white areas) form a cavity content of at least 10 to at most 35% by volume.

Figure 2:
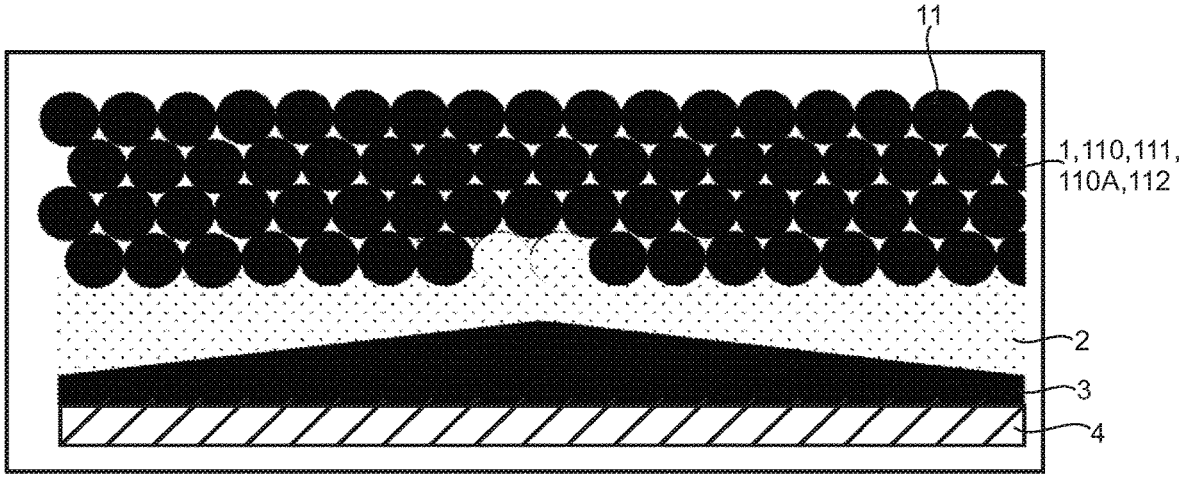

The ball elements 11 are each formed with a hard core 110 and an outer layer 111 (In FIG. 1, as in FIG. 2, these are not explicitly shown within a ball for reasons of simplification, but are present. Corresponding reference signs are set in the figures). On a Shore D scale, the outer layer 111 is at least two points softer than the hard core 110 of each of the spherical elements 11.

Alternatively or additionally, instead of the formation of the ball elements 11 in the form of a hard core 110 with surrounding outer layer 111, the ball element 11 itself can be formed with a hard core 110, in which case the outer layer 111 is omitted. In such a case, however, it may be provided that instead of the outer layer 111, the individual hard cores 110 are joined together by means of a bonding adhesive, for example an organic or inorganic adhesive, arranged on the outer surface of the hard cores 110.

The main layer 1 shown in FIG. 1 and FIG. 2 is therefore specifically designed and intended to withstand compressive and shear forces exerted on the main layer 1, preferably to deform accordingly, provided that the main layer 1 is loaded from one direction, but after removal of the load the main layer 1 returns at least partially, preferably completely, to its original shape. In this respect, the main layer 1 is an at least partially elastic material. It can be seen that the drainage layer 3 is arranged on a road floor, whereby the road floor is provided with the reference sign 4.

The invention is not limited by the design example, but comprises any invention and any combination of features, even if these features are not explicitly described in the patent application.

The invention claimed is:

1. An asphalt road surfacing system (100), comprising:

at least one main layer (1), at least partially and at least in places permeable to liquids and gases, for absorbing compressive and shear forces generated on the main layer (1) by load bodies moving and/or standing on the main layer (1), wherein the main layer (1) is arranged on a first drainage layer (2) through which liquids and/or gases can flow, and further wherein the first drainage layer (2) is again arranged all around on a second drainage layer (3), wherein the second drainage layer (3) is arranged and provided for at least partially draining liquids from the road surface system (100) through the main and drainage layers (1, 2), and wherein the main layer (1) is substantially free from aggregates, and instead is formed with ball elements (11) adhering to each other, which are formed with a plastic and/or a metal.

2. The road surfacing system (100) according to claim 1, wherein the first drainage layer (2) is at least partially formed with aggregates.

3. The road surfacing system (100) according to claim 2, wherein the ball elements (11) produce a void content in volume % within the main layer (1) of at least 20 to at most 30.

4. The road surfacing system (100) according to claim 2, wherein the ball elements (11) produce a void content in volume % within the main layer (1) of at least 22.0 to at most 28.0.

5. The road surfacing system (100) according to claim 1, wherein the ball elements (11) produce a void content in volume % within the main layer (1) of at least 10 to at most 35.

6. The road surfacing system (100) according to claim 5, wherein the load bodies are vehicles.

7. The road surfacing system according to claim 1, wherein the ball elements (11) are each formed with a hard core (110) and an outer layer (111) which preferably completely surrounds the hard core (110), wherein the outer layer (111) is formed with a material which is softer than the hard core (110) on a Shore D scale.

8. The road surfacing system (100) according to claim 7, wherein the outer layer (111) is softer by at least two points on the Shore D scale than the hard core (110) of each of the ball elements (11).

9. The road surfacing system (100) according to claim 7, wherein the hard core (110) is formed with a metal, and the outer layer (111) is formed with the plastic and/or or an adhesive.

10. The road surfacing system (100) according to claim 9, wherein the ball elements (11) are mechanically bonded to one another by means of their outer layers (111), which are cured after previous heating, and/or by means of a cured bonding agent (112).

11. The road surfacing system (100) according to claim 10, wherein the cured bonding agent (112) is a bonding adhesive.

12. The road surfacing system (100) according to claim 10, wherein the outer layer (111) of the balls (11) and/or the cured bonding agent (112) is formed by means of an organic or inorganic adhesive.

13. Main layer (1) part of an asphalt road, wherein the main layer (1) is at least partially and at least in places permeable to liquids and gases, and the main layer (1) is arranged and provided to withstand pressure and/or shear forces generated thereon by load bodies moving and/or standing on the main layer (1), and wherein the main layer (1) is substantially free from aggregates, and instead is formed with ball elements (11) adhering to each other, which are formed with a plastic and/or a metal.

14. The main layer (1) part of an asphalt road according to claim 13, wherein the load bodies are vehicles.

15. Method for producing an asphalt road surfacing system (100) comprising the steps of:

applying a first drainage layer (3) on a road floor (4), applying a second drainage layer (2) on the first drainage layer (3), applying a main layer (1) to the second drainage layer (2), wherein the main layer (1) is at least partially and at least in places permeable to liquids and gases, and the main layer (1) is designed and intended to withstand pressure and/or shear forces generated thereon by load bodies moving and/or standing on the main layer (1), wherein the second drainage layer (2) is adapted to be at least partially permeable to liquids and/or gases, wherein the first drainage layer (3) is arranged and intended to at least partially drain liquids from the road surfacing system (100) through the main and second drainage layers (1, 2), and, wherein the main layer (1) is substantially free from aggregates and is instead formed with ball elements (11) formed with a plastic and/or metal, in particular wherein an outer surface (110A) of the ball elements (11) is applied to the second drainage layer (2) in the still heated state, which can be bonded thereto, so that after application, the individual ball elements (11) cool down to an ambient temperature during cooling and thus bond to each other, so that a hardened road surface, in particular in the form of the main layer (1), results.

16. The method for producing an asphalt road surfacing system (100) according to claim 15, wherein the load bodies are vehicles.

* * * * *